US005174461A

United States Patent [19]

Sullivan

[11] Patent Number: 5,174,461

[45] Date of Patent: Dec. 29, 1992

[54] WINE BARREL

[76] Inventor: Stephen T. Sullivan, P.O. Box 713, Kenwood, Calif. 95452

[21] Appl. No.: 824,595

[22] Filed: Jan. 23, 1992

[51] Int. Cl.[5] ..... B65D 8/00

[52] U.S. Cl. ..... 217/88; 217/72; 217/90; 217/30 B

[58] Field of Search ..... 217/88, 72, 73, 90, 217/3 R, 30 B; 220/410

[56] References Cited

U.S. PATENT DOCUMENTS

| | | | |
|---|---|---|---|
| 328,700 | 10/1885 | McCrodden | 217/73 |
| 633,443 | 9/1899 | Frasier | 217/73 |
| 1,009,326 | 11/1911 | MacGregor | 217/73 |
| 2,069,531 | 2/1937 | Lehner | 217/88 |
| 2,114,686 | 4/1938 | Roberts et al. | 217/88 X |
| 2,289,245 | 7/1942 | Dant | 217/3 CB |
| 2,649,124 | 8/1953 | Merron | 217/88 X |
| 4,813,565 | 3/1989 | Croser | 217/88 |
| 5,054,381 | 10/1991 | De Piaux et al. | 217/3 CB X |

*Primary Examiner*—Stephen P. Garbe
*Assistant Examiner*—Vanessa Caretto
*Attorney, Agent, or Firm*—Larry D. Johnson

[57] ABSTRACT

A wine barrel provides a stainless steel barrel body having at least one removable end, with at least one circumferential stave holder member secured to the barrel inside surface. This stave holder bears a plurality of stave receiving portions for releasable capture of oak stave elements.

6 Claims, 2 Drawing Sheets

WINE BARREL

BACKGROUND OF THE INVENTION

1. Field of the Invention

This invention relates generally to barrels and other containers, and more specifically to an improved wine barrel enabling the use of replaceable staves.

2. Description of the Prior Art

Wine barrels are well known, and are typically constructed of oak or similar wood material, which assists in the aging of the wine and imparts a desirable flavoring characteristic to the wine. Unfortunately, wooden barrels are expensive and difficult to maintain, and may only be used for a limited period of time before they must be replaced. The use of stainless steel barrels solves many of these problems, but by their very nature these metal barrels do not yield the desirable wood characteristics to the wine.

SUMMARY OF THE INVENTION

The improved wine barrel of this invention provides a stainless steel (or other inert material) barrel body having at least one removable end, with at least one circumferential stave holder member secured to the barrel inside surface. This stave holder member bears a plurality of stave receiving portions for releasable capture of oak or other wooden stave elements.

This improved wine barrel is designed in identical fashion to a Bordeaux/Export style French oak barrel with the exception that it should be slightly larger in order to accommodate the volume displaced by the stave inserts. The dimensions of a traditional Bordeaux-/Export style barrel are as follows:

| | |
|---|---|
| Capacity: | 225 liters |
| Stave length: | 95 cm. |
| Bilge Diameter: | 69.7 cm. |
| Head Diameter: | 54 cm. |
| Stave Thickness: | 21-27 millimeters |
| Barrel Wt.: | 56 kg. |

The concept of the inventive barrel is basically to provide the same amount of wood surface area to wine volume ratio as a standard sixty gallon Bordeaux/Export style barrel, but utilizing less than twenty percent of the wood that is required in the conventional barrel. The inventive barrel does not require the traditional techniques for assembly, and is designed with efficiency in mind with regards to ease of maintenance and conservation of water used in cleaning.

Advantages over conventional barrels include:

1. The inventive stainless steel barrel will provide use for as long as a stainless steel tank, so essentially it will become a permanent tool in the wine cellar.

2. The user has the ability to control the oxidation of the wine.

3. The ullage should be less than one percent per year.

4. The inventive barrel offers greater ease of maintenance, in that stainless steel can be sterilized.

5. Use of the inventive barrel is water conserving, since there is no soak-up and considerably less water needed to clean stainless steel, and the wood staves can be taken out and cleaned in a bath.

6. The inventive barrel is designed to fit in all the same spaces and on the same pallets used in the industry for the American or French Bordeaux style barrel.

7. The bung hole is of a size and texture to accommodate a standard size bung.

8. The invention barrel gives the user the versatility to maintain a preferred wine to wood ratio just by inserting the type and quantity of wood desired. In addition, the blending of woods (Nevers/Allier, French/American) is easily accomplished.

9. Very little maintenance would be required while the inventive barrel is full, and the maintenance after emptying would be as follows:

A. Rinse the interior of the barrel after removing the head plate.

B. Pull out all of the staves and soak in a bath of light caustic or citric depending on the tartaric buildup on the wood. Once the staves are cleaned and rinsed, stack them to dry thoroughly. After they are dried, they can be vacuum packed with sulfur gas and stored inside the bilge area of the barrel.

C. The stainless steel barrel can be cleaned after the staves have been removed in any manner that is used in the cellar to clean stainless steel tanks.

10. The stave wood need only be half the thickness of a stave designed for a conventional barrel. Less than twenty percent of the wood used in a conventional barrel would be needed in the inventive barrel because the wine is in contact with all four sides of the stave.

11. Although the stave wood designed for use in the inventive barrel would still have to be harvested, air dried, hand split, fire bent and toasted, the coopering of the barrel would no longer be required.

12. The user has the ability to cannibalize pre-existing barrels for their oak. The barrels can be broken down, the staves planed down to new wood, re-toasted and used in the inventive barrels, thereby doubling the life of the user's current oak inventory.

DETAILED DESCRIPTION OF A PREFERRED EMBODIMENT

Figure 1:
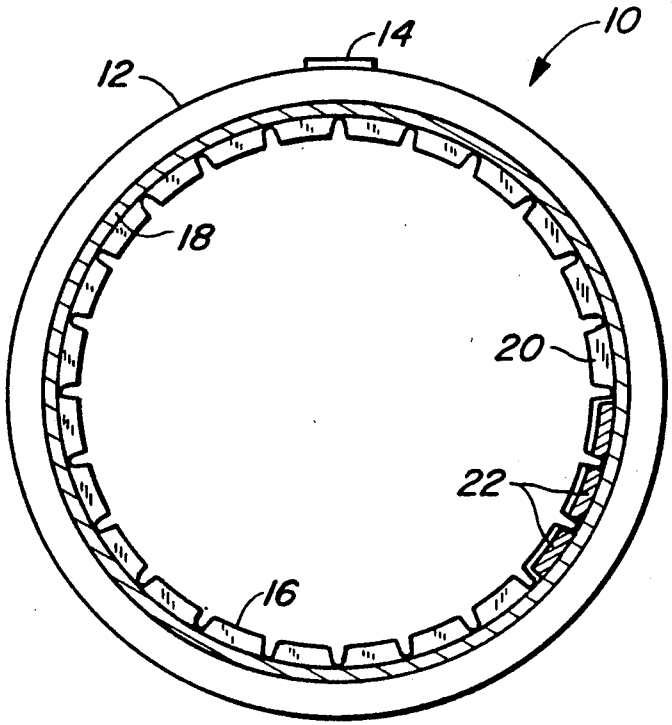
FIG. 1 is an end elevation view of an improved wine barrel of this invention, illustrating a barrel body (with one barrel head removed), barrel bung, one inside circumferential stave holder member secured to the inside surface of the barrel body and defining a plurality of stave receiving portions around the inside circumference of the barrel body, and a pair of stave elements as inserted into and captured by a pair of adjacent stave receiving portions, this view taken along line 1—1 of FIG. 2.

FIG. 1 is an end elevation view of an improved wine barrel 10 of this invention, illustrating a stainless steel barrel body 12 (with one barrel head removed), barrel bung 14, one (of preferably two) inside circumferential stave holder member 16 secured to the inside surface 18 of the barrel body and defining a plurality of stave receiving portions 20 around the inside circumference of the barrel body, and a pair of oak stave elements 22 as inserted into and captured by a pair of adjacent stave receiving portions 20. Stave holder members(s) 16 are preferably made of one-quarter inch stainless steel wire bent to form the plurality of stave receiving portions 20, and spot welded to the inside surface of the barrel body approximately two inches from each end. The stave receiving portions may extend approximately one inch radially inwards from the barrel inside surface, and be of a width to releasably accommodate a typical wood stave.

Figure 2:
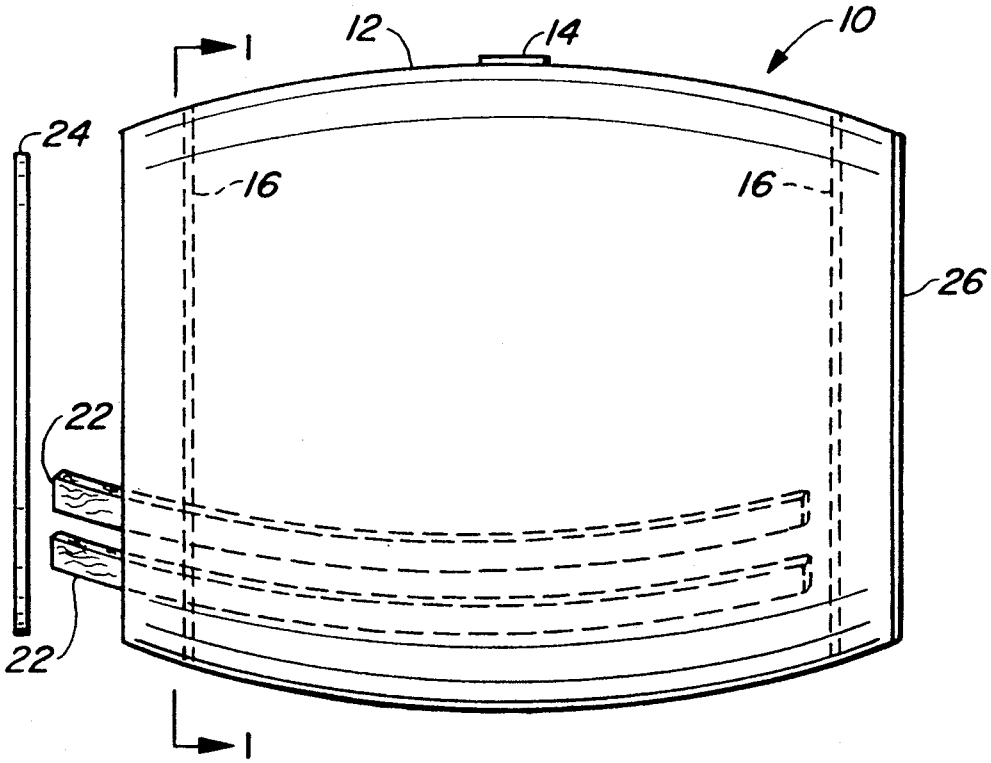
FIG. 2 is a side elevation view of the improved wine barrel of this invention, illustrating the barrel body, a removable barrel head, a sealed barrel head, the barrel bung, an aligned pair of circumferential stave holder members (illustrated in phantom) proximate the respective ends of the barrel body, and a pair of stave elements being inserted into stave receiving portions of the stave holder members.

FIG. 2 is a side elevation view of the improved wine barrel 10 of this invention, illustrating the barrel body 12, a removable barrel head 24, a sealed barrel head 26, the barrel bung 14. an aligned pair of circumferential stave holder members 16 (illustrated in phantom) proximate the respective ends of the barrel body, and a pair of stave elements 22 being inserted into stave receiving portions of the stave holder members. This removable barrel head 24 may consist of a stainless steel plate and lock ring arrangement sealing against a silicone 0-ring, or any other suitable closure technique.

Figure 3:
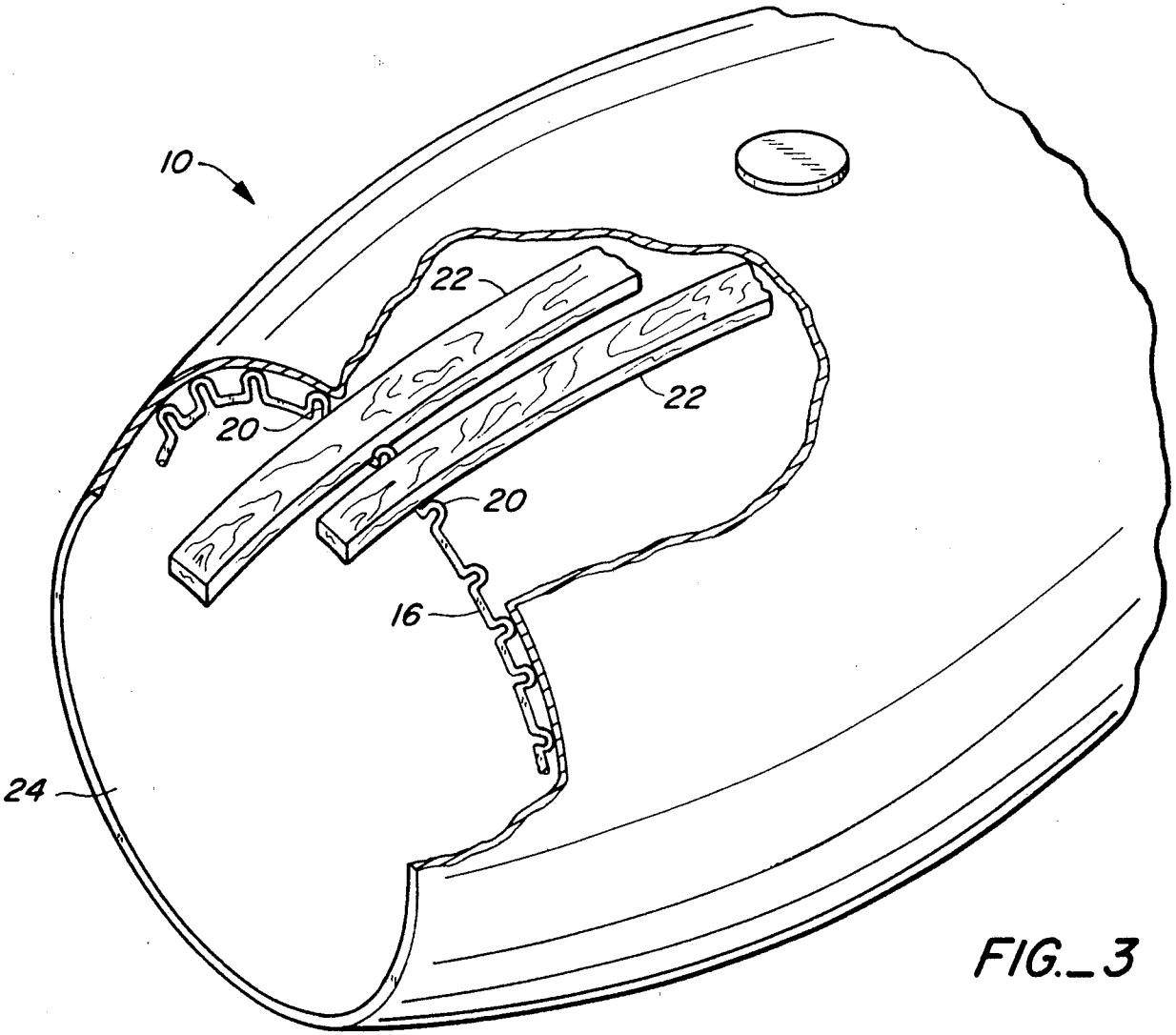
FIG. 3 is a partially cutaway perspective view of the improved wine barrel of this invention, illustrating a pair of stave elements fully inserted into and captured by adjacent stave receiving portions of the circumferential stave holder member, and the removable barrel head having been replaced to seal the barrel body end.

FIG. 3 is a partially cutaway perspective view of the improved wine barrel 10 of this invention, illustrating a pair of stave elements 22 fully inserted into and captured by adjacent stave receiving portions 20 of the circumferential stave holder member 16, and the removable barrel head 24 having been replaced on the barrel to seal the barrel body end.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A wine barrel comprising:

a barrel body having a pair of ends, at least one of said ends being removable, said barrel body having an inside surface;

at least one circumferential stave holder member secured to and extending completely around said barrel body inside surface, said circumferential stave holder member bearing a plurality of stave receiving portions; and at least one stave element conditioned for releasable capture by said stave receiving portion.

2. The wine barrel of claim 1 including a pair of circumferential stave holder members, each secured proximate said barrel body ends.

3. The wine barrel of claim 1 wherein each of said stave receiving portions releasably captures a stave element.

4. The wine barrel of claim 1 wherein said barrel body is composed of stainless steel.

5. The wine barrel of claim 1 wherein said stave element is composed of oak.

6. A wine barrel comprising:

a barrel body having a pair of ends, at least one of said ends being removable, said barrel body having an inside surface;

at least one circumferential stave holder member composed of stainless steel and secured to said barrel inside surface, said circumferential stave holder member bearing at least one stave receiving portion; and at least one stave element conditioned for releasable capture by said stave receiving portion.

* * * * *